US006764171B2

(12) United States Patent
Tham

(10) Patent No.: US 6,764,171 B2
(45) Date of Patent: Jul. 20, 2004

(54) PRESSURE REGULATOR, CARTRIDGE USING THE SAME AND METHOD FOR INDICATING REMAINING CARTRIDGE CONTENT

(75) Inventor: Hing Ching Tham, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/293,068

(22) Filed: Nov. 13, 2002

(65) Prior Publication Data

US 2004/0090502 A1 May 13, 2004

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS 5,434,603 A 7/1995 Hunt
5,541,632 A 7/1996 Khodapanah et al.
5,754,207 A * 5/1998 Gragg et al. ..... 347/86
5,898,451 A * 4/1999 Kaplinsky et al. ..... 347/87

* cited by examiner

*Primary Examiner*—Anh T. N. Vo

(57) ABSTRACT

A pressure regulator for maintaining a negative pressure in an ink reservoir of a liquid ink cartridge is disclosed. The pressure regulator includes at least a prop plate for propping a moveable wall away from another wall of the reservoir. A biasing means is attached to the plate a predetermined distance away from a central axis of the plate for urging the plate against the moveable wall to space apart the pair of walls and to allow controlled lopsided collapse of the moveable wall. An ink jet printer ink cartridge that includes the pressure regulator in a reservoir is also disclosed. An indicator member is attached to the moveable wall of the reservoir and viewable from outside of the housing. The pressure regulator is placed within the reservoir with the biasing means adjacent the indicator member. A method of indicating an amount of remaining ink in the reservoir is also disclosed.

12 Claims, 4 Drawing Sheets

PRESSURE REGULATOR, CARTRIDGE USING THE SAME AND METHOD FOR INDICATING REMAINING CARTRIDGE CONTENT

BACKGROUND

This invention relates generally to ink cartridges that require an ink pressure regulator for maintaining a backpressure, that is negative pressure, in an ink reservoir. More particularly, this invention relates to ink cartridges wherein indication of the amount of ink remaining in the reservoir depends on the operation of the pressure regulator.

Ink cartridges that use an ink pressure regulator to indicate the ink level are known. An example of such ink cartridges is a thermal ink jet print cartridge described in U.S. Pat. No. 5,434,603, Hunt, "Ink Cartridge with Passageway for Ink Level Indicator." The print cartridge has an ink reservoir in a rigid cartridge housing and provides a visual indication of remaining ink quantity in the ink reservoir. An ink pressure regulator biases the ink reservoir to create a negative pressure therein. During use the reservoir collapses as the ink supply decreases due to differential pressure exerted thereto.

A pair of flexible tape members are cemented or welded, one to each side of the reservoir. The tape members extend generally parallel toward a narrow end surface of the cartridge housing at which they overlap and are viewable through a window. The overlapping relationship of the tape members provides an ink quantity indicium. As the reservoir collapses, the reservoir draws the free ends of the tape members apart to thereby give an indication of the amount of ink remaining in the reservoir.

An example of the ink pressure regulator is described in U.S. Pat. No. 5,541,632, Khodapanah et al., "Ink Pressure Regulator for a Thermal Ink Jet Printer." The ink pressure regulator is placed inside a flexible ink bag to form the spring-biased reservoir described above. The pressure regulator includes a bow spring which is sandwiched centrally between a pair of plates and is configured to have substantially linear force/deflection characteristics. The spring collapses to a substantially flat shape to minimize the amount of ink remaining after printing has depleted the ink from the reservoir.

Consistency and accuracy of ink quantity indication depends on the manner in which the pair of plates collapses towards each other. Ideally, the two plates should be kept parallel as they collapse. Although the design of the bow spring ensures to a large extent that the two plates collapse substantially parallel to each other, there are instances when the plates collapse in a non-parallel manner, such as when the print cartridges are subjected to shock. Subjecting a print cartridge to shock may cause the plates to collapse first at a corner or an edge. If the edges of the plates adjacent the tape members collapse first, the ink quantity indicator will be caused to prematurely indicate that the cartridge is empty when in fact the cartridge still has a substantial amount of ink remaining in the reservoir.

SUMMARY

According to an aspect of the present invention, there is provided a pressure regulator for maintaining a negative pressure in a reservoir of a cartridge. The reservoir has a pair of walls, at least one of which is moveable with respect to the other. The pressure regulator includes at least a prop plate for propping the moveable wall, the plate having a central axis therethrough. The pressure regulator also includes a biasing means attached to the plate a predetermined distance away from the central axis for urging the plate against the moveable wall to space apart the pair of walls and to allow controlled lopsided collapse of the moveable wall.

According to another aspect of the present invention, there is provided a cartridge. The cartridge includes a housing and a reservoir supported in the housing. The reservoir has at least a first wall moveable with respect to a second wall. An indicator member is attached to the moveable wall and viewable from outside of the housing. The cartridge also includes a pressure regulator supported within the reservoir. The regulator has at least a plate for propping the moveable wall, the plate having a central axis therethrough. The regulator also includes an off-axis biasing means attached to the plate a predetermined distance away from the central axis towards the indicator member to urge the plate and thus the moveable wall away from the second wall.

According to yet another aspect of the present invention, there is provided a method of indicating an amount of remaining content in a reservoir of a cartridge. The reservoir has at least a first wall moveable with respect to a second wall. The method includes attaching an indicator member to the moveable wall and propping the moveable wall with at least a plate. The plate has a central axis therethrough. The method further includes biasing the plate at a position that is a predetermined distance away from the central axis for urging the plate against the moveable wall to space apart the moveable wall from the second wall. The moveable wall is allowed to collapse in a predetermined lopsided manner to thereby move the attached indicator member as the content of the reservoir is being consumed.

BRIEF DESCRIPTION OF DRAWINGS

The invention will be better understood with reference to the drawings, in which.

DETAILED DESCRIPTION

Hereafter, a preferred embodiment of the present invention will be described in the context of a thermal ink jet print cartridge. However, it is to be understood that the invention is usable with any cartridge having a collapsible reservoir that is used to indicate the amount of remaining content in the reservoir when its content is consumed.

Figure 1:
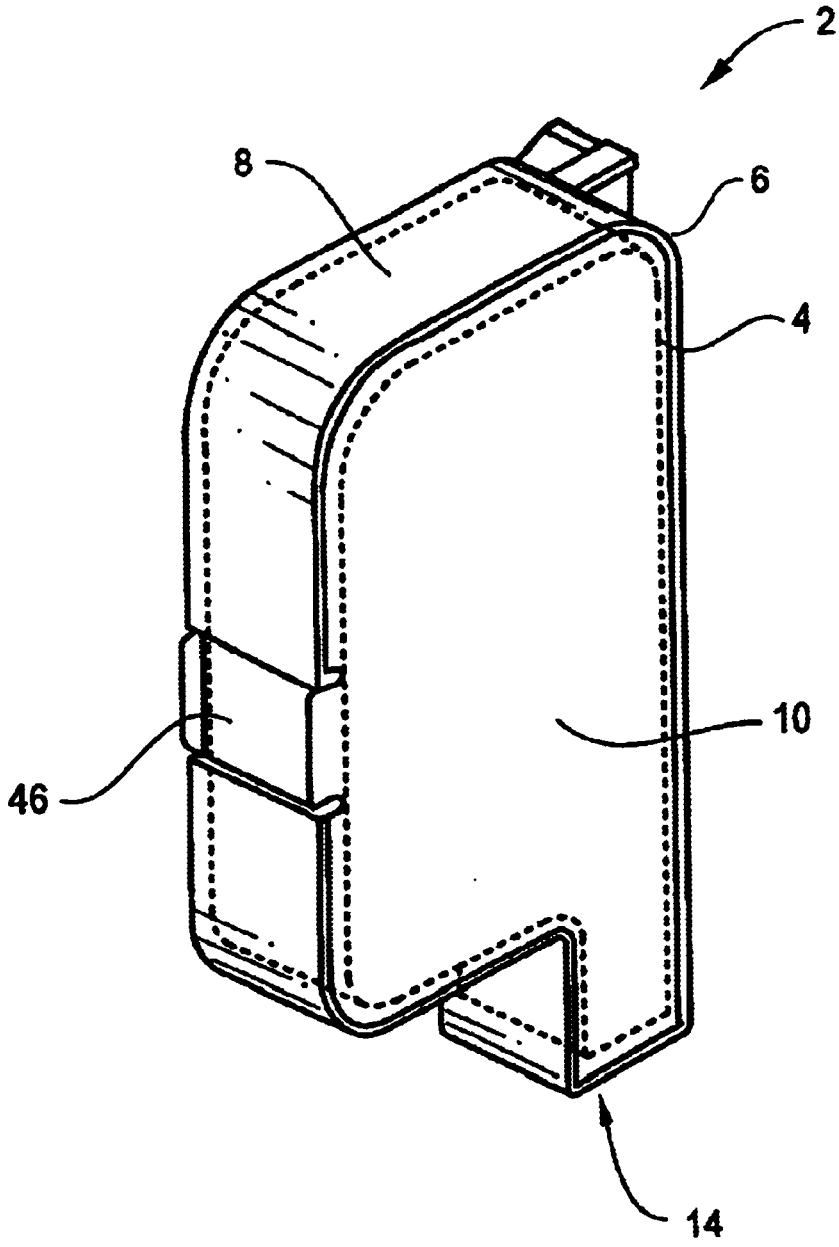
FIG. 1 is an isometric drawing of a thermal ink jet print cartridge having a pressure regulator according to an embodiment of the present invention.

FIG. 1 is an isometric drawing of a thermal ink jet print cartridge 2 having an enclosed spring-biased collapsible ink reservoir 4. The print cartridge 2 has a rigid housing 6 that includes an external peripheral frame 8 and a pair of parallel opposing cover plates 10. The print cartridge 2 includes an ink discharge aperture 12 (FIG. 2) at a snout portion 14 of the print cartridge 2. An ink ejection print head (not shown), such as an electrically-driven print head, is attached adjacent to the aperture 10 for on-demand ejection of ink onto a print medium.

Figure 2:
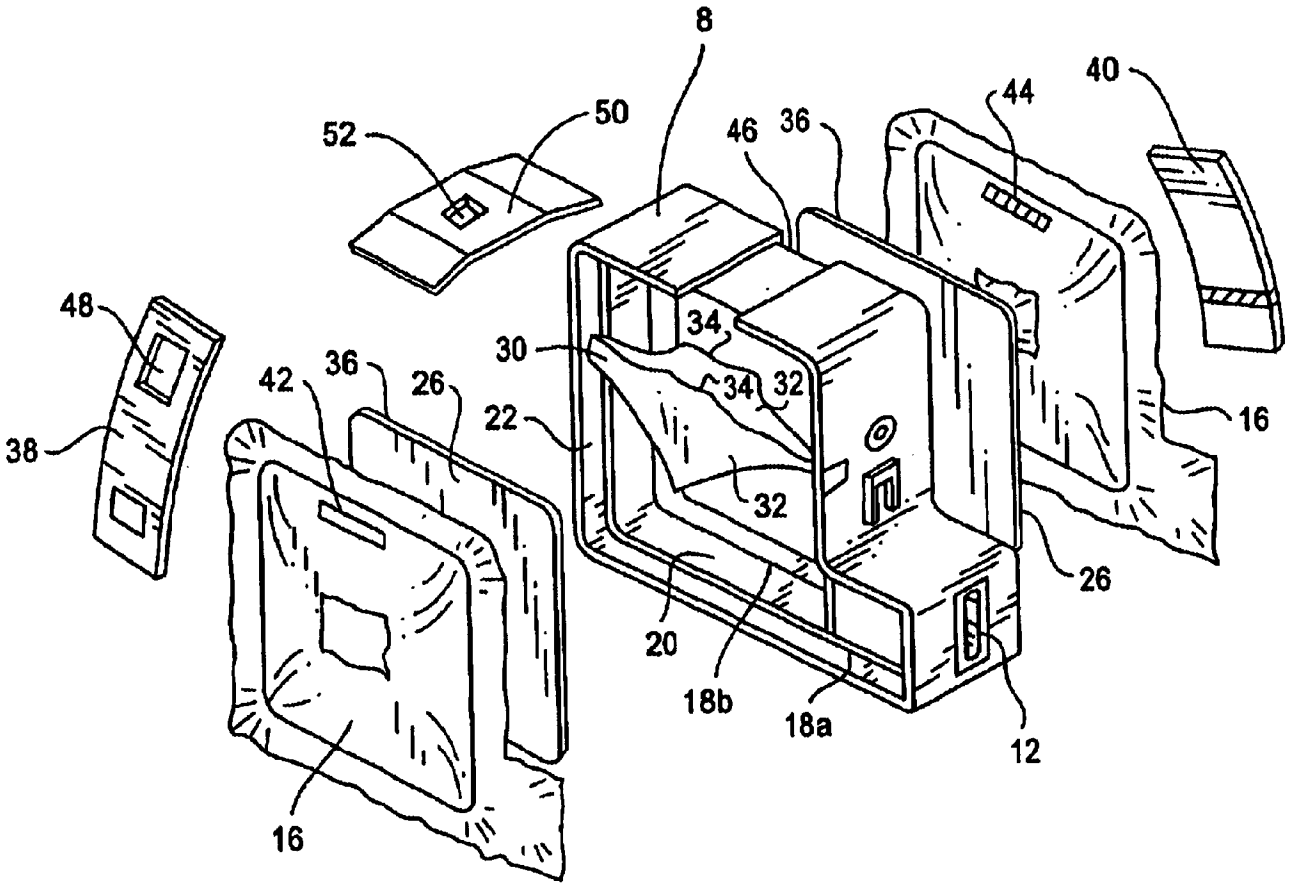
FIG. 2 is an exploded isometric drawing of the print cartridge in FIG. 1.

FIG. 2 is an exploded drawing of the print cartridge 2. The ink reservoir 4 is defined by two sidewalls 16 attached to opposite side edges 18*a*, 18*b* of an inner peripheral frame 20 that runs along an inner surface 22 of the external peripheral frame 8. The two sidewalls 16 are of a flexible material and are moveable towards and away from each other. Enclosed centrally within the inner peripheral frame 20 between the two sidewalls 16 is a pressure regulator 24 (FIG. 3).

Figure 3:
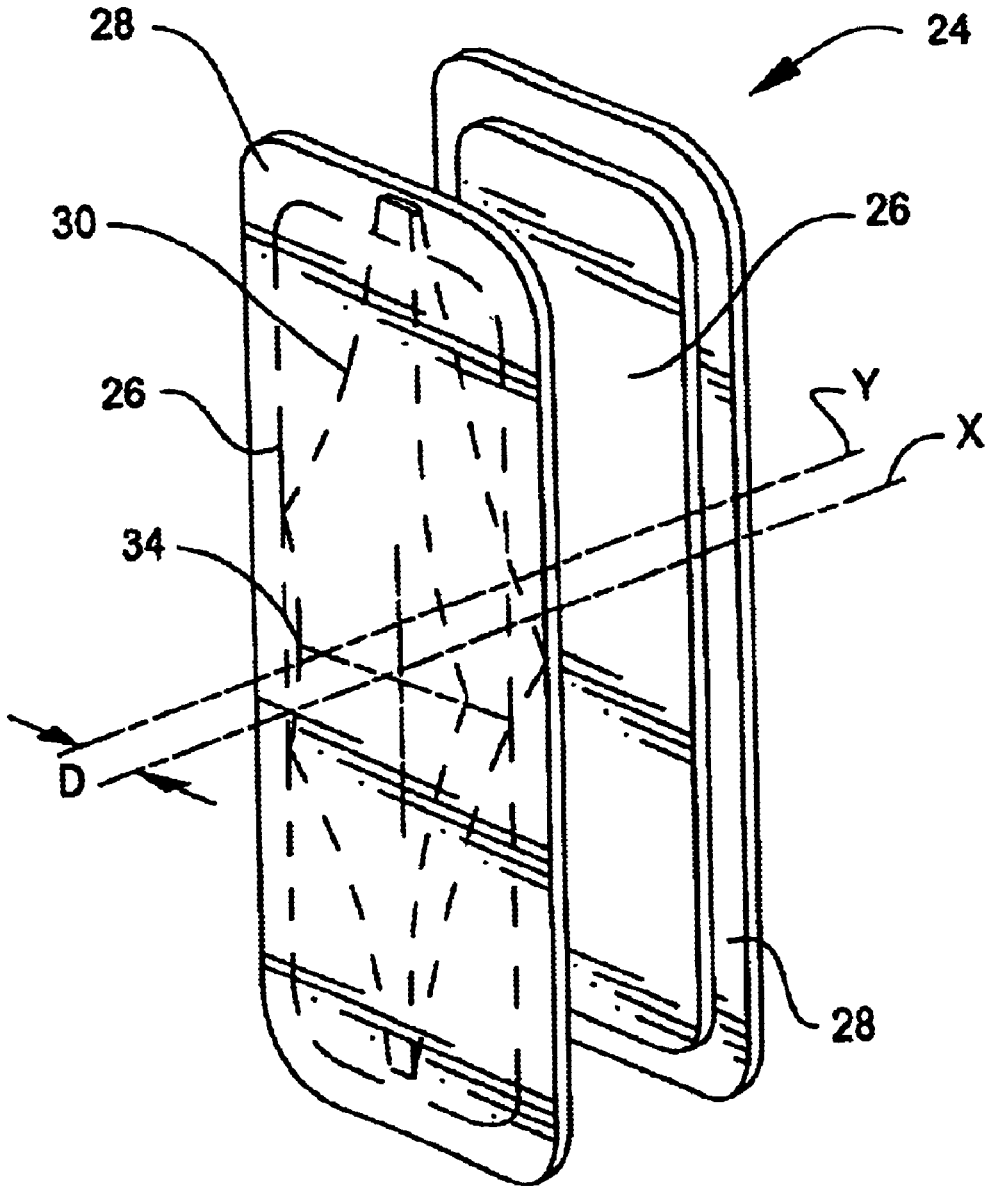
FIG. 3 is an exploded isometric drawing of the pressure regulator in FIG. 1.
Figure 4:
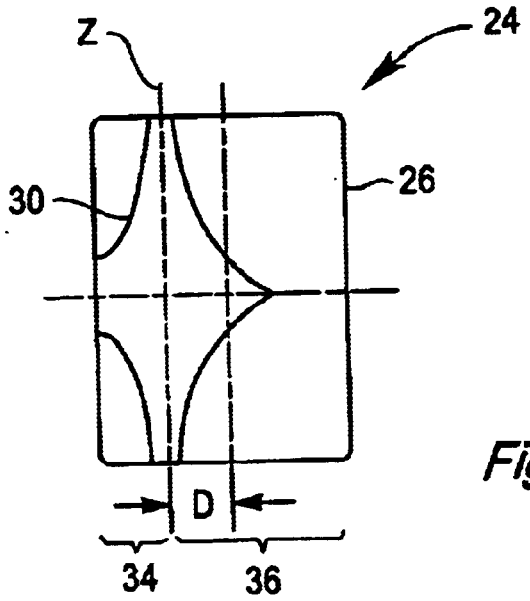
FIG. 4 is a plan view of the pressure regulator in FIG. 3.
Figure 5A:
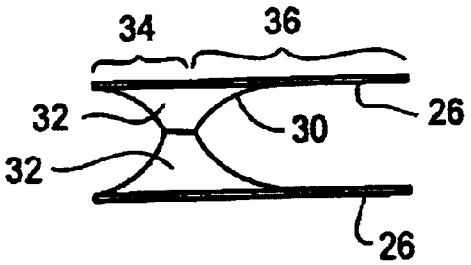
FIG. 5A is a side view of the pressure regulator in an unused position when installed in a print cartridge whose reservoir is filled with ink.

FIG. 3 is an isometric drawing of the pressure regulator 17. The pressure regulator 16 includes two side prop plates 26 that are generally rectangular in shape. These two prop plates 26 are attached to the flexible sidewalls 16 of the reservoir 4. The prop plates 26 have corners that are rounded to minimize damaging the flexible sidewalls 16. An optional protective layer 28 in the form of a thin, but tough polyethylene cover layer having an area larger than the prop plates 26 may be attached to the sidewall-facing surfaces of the prop plates 26, prior to attaching the prop plates 26 to the reservoir sidewalls 16 as shown in FIG. 3. The pressure regulator 24 further includes a biasing means, such as a spring 30 having a bow-shaped cross section, that is sandwiched between the two prop plates 26 to urge them apart. In doing so, the flexible sidewalls 16 supported by the prop plates 26 are spaced apart to create a negative pressure within the reservoir 4 for keeping ink therein. The prop plates 26 are aligned to have a common central axis X therethrough. The bow spring 30 is attached, for example by welding or cementing the bow spring 30 with its axis Y, a predetermined distance D away from the central axis X of the prop plates 26. The bow spring 30 includes a pair of opposing segments 32. A side 34 of each segment 32 extends to an adjacent edge 36 of the prop plate 26. Such a positioning of the bow spring 30 between the two prop plates 26 allows controlled lopsided collapse of the moveable sidewalls 16. The bow spring 20 divides each prop plate 26 along an axis Z into a first smaller plate portion 34 on one side of the axis Z and a second larger plate portion 36 on an opposite side of the axis Z as shown in FIG. 4. The smaller plate portion 34 is better supported by the bow spring 20 while the larger plate portion 60 is supported less. Prior to use, the prop plates 26 are held substantially parallel when the reservoir 4 is filled with ink as shown in FIG. 5A. The operation of the pressure regulator 24 as ink is drawn from the reservoir 4 will be described shortly.

A first indicator strip 38 and a second indicator strip 40 are attached to the reservoir sidewalls 16 at sidewall portions 42, 44 that are indirectly supported by the smaller prop plate portions 34. The first and second indicator strips 38, 40 extend out of the interior of the housing 6 to be viewable from outside of the housing 6. The indicator strips 38, 40 overlap along a channel 46 on the external peripheral frame 8 with the second indicator strip 40 under the first indicator strip 38. The second indicator strip 40 is thus viewable through a slot 48 in the first indicator strip 38. A window member 50 with a window 52 is placed over the indicator strips 38, 40.

Figure 5B:
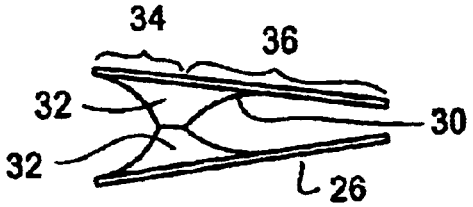
FIG. 5B is a side view of the pressure regulator in a first collapsed position when ink is initially drawn from the print cartridge.
Figure 5C:
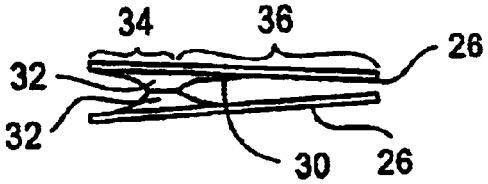
FIG. 5C is a side view of the pressure regulator in a second collapsed position after more ink is drawn from the print cartridge in FIG. 1.

During use of the print cartridge 2, the less supported larger plate portions 36 and thus the portions of the sidewalls 16 thereby supported collapse first as ink is consumed as shown in FIG. 5B. The larger plate portions 36 collapse first because they are supported less by the off-axis spring 30 as compared to the smaller plate portions 34. There will come a point in time as the larger plate portions 36 collapse when the smaller plate portions 34 begin to collapse as well as shown in FIG. 5C. The bow spring 30 can be positioned such that the larger plate portions 36 completely collapse prior to the collapse of the smaller plate portions 34. As the smaller plate portions 34 collapse inwardly towards each other, the indicator strips 38, 40 are drawn along with them. The drawing apart of the indicator strips 38, 40 in this manner is used to indicate the remaining ink in the reservoir 4.

The materials and detailed structure of the ink cartridge parts, and the method of manufacturing the print cartridge 2 are described in several patents, including U.S. Pat. No. 5,434,603, Hunt, "Ink Cartridge with Passageway for Ink Level Indicator" and U.S. Pat. No. 5,541,632, Khodapanah et al., "Ink Pressure Regulator for a Thermal Ink Jet Printer."

Advantageously, with the off-axis bow spring, the chances of premature indication of an empty print cartridge condition is reduced as compared to that in the prior art.

Although the present invention is described as implemented in the above-described embodiment, it is not to be construed to be limited as such. For example, instead of having two moveable sidewalls 16, the print cartridge 2 can function with a single moveable sidewall. In such a case, the pressure regulator requires only a single prop plate for propping the moveable sidewall.

I claim:

1. A pressure regulator for maintaining a negative pressure in a reservoir of a cartridge, the reservoir having a pair of walls, at least one of which is moveable with respect to the other, the pressure regulator comprising:

at least a prop plate for propping the moveable wall, the plate having a central axis therethrough; and a biasing means attached to the plate a predetermined distance away from the central axis for urging the plate against the moveable wall to space apart the pair of walls and to allow controlled lopsided collapse of the moveable wall.

2. A pressure regulator according to claim 1, wherein the biasing means divides the plate into a first larger plate portion on one side of an axis of the biasing means and a second smaller plate portion on an opposite side of the axis to thereby allow a portion of the moveable wall supported by the larger portion to first collapse before the collapse of another portion of the moveable wall supported by the smaller plate portion.

3. A pressure regulator according to claim 2, wherein the biasing means is a spring having a bow-shaped cross section.

4. A pressure regulator according to claim 3, wherein the spring extends to an edge of the prop plate.

5. A pressure regulator according to claim 1, wherein the at least one prop plate includes a first and a second prop plate, each prop plate for propping a respective wall of the pair of walls.

6. A cartridge comprising:

a housing;

a reservoir supported in the housing, the reservoir having at least a first wall moveable with respect to a second wall;

an indicator member attached to the moveable wall and viewable from outside of the housing; and a pressure regulator in the reservoir, the regulator including:

at least a plate for propping the moveable wall, the plate having a central axis therethrough; and an off-axis biasing means attached to the plate a predetermined distance away from the central axis towards the indicator member to urge the plate and the moveable wall away from the second wall.

7. A cartridge according to claim 6, wherein the biasing means is a spring having a bow-shaped cross section.

8. A print cartridge according to claim 7, wherein the spring extends to an edge of the plate.

9. A cartridge according to claim 8, wherein the second wall is also moveable and wherein the at least one prop plate includes a first and a second prop plate, each plate for propping a respective one of the first and the second moveable walls.

10. A method of indicating an amount of remaining content in a reservoir of a cartridge, the reservoir having at least a first wall moveable with respect to a second wall, the method comprising:

attaching an indicator member to the moveable wall;

propping the moveable wall with at least a plate, the plate having a central axis therethrough;

biasing the plate at a position that is a predetermined distance away from the central axis for urging the plate against the moveable wall to space apart the moveable wall from the second wall;

filling the reservoir; and allowing the moveable wall to collapse in a predetermined lopsided manner to thereby move the attached indicator member as the content is being consumed.

11. A method according to claim 10, wherein allowing the moveable wall to collapse in a predetermined lopsided manner includes allowing a less supported portion of the moveable wall to collapse prior to the collapse of a better supported portion of the moveable wall.

12. A method according to claim 11, wherein allowing a less supported portion of the moveable wall to collapse includes allowing the less supported portion of the moveable wall to collapse completely before the collapse of the better supported portion of the moveable wall.

* * * * *